United States Patent [19]

Davis et al.

[11] Patent Number: 5,054,832

[45] Date of Patent: Oct. 8, 1991

[54] FISHING TOOL FOR RETRIEVING IMPLEMENTS FROM A HOLE

[75] Inventors: Bob G. Davis; Barry L. Antweil, both of Hobbs, N. Mex.

[73] Assignee: WADA Ventures, Hobbs, N. Mex.

[21] Appl. No.: 550,561

[22] Filed: Jul. 10, 1990

[51] Int. Cl.[5] ..... E21B 31/18

[52] U.S. Cl. ..... 294/86.3; 294/86.17; 294/102.2

[58] Field of Search ..... 294/86.1, 86.13, 86.17, 294/86.22, 86.26, 86.3, 86.31, 86.33, 86.34, 96, 102.1, 102.2

[56] References Cited

U.S. PATENT DOCUMENTS

| | | | |
|---|---|---|---|
| 529,781 | 11/1894 | Craelius . | |
| 885,478 | 4/1908 | Hollingsworth . | |
| 1,491,463 | 4/1924 | Clulow | 294/86.3 |
| 1,581,010 | 4/1926 | Murray . | |
| 1,616,024 | 2/1927 | Brust | 294/86.3 |
| 1,720,692 | 7/1929 | Reynolds et al. | 294/86.33 |
| 1,732,962 | 10/1929 | Brust | 294/86.3 |
| 1,778,968 | 10/1930 | Towne | 294/86.3 |
| 2,067,009 | 1/1937 | Hinderliter | 294/86.3 X |
| 2,201,434 | 5/1940 | Gallagher | 294/86.3 X |
| 2,275,911 | 3/1942 | Le Bus | 294/86.22 |
| 2,492,813 | 12/1949 | Osman | 294/86.3 |
| 2,595,008 | 4/1952 | Sill . | |
| 2,970,859 | 2/1961 | Justice | 294/86.17 |
| 4,157,199 | 6/1979 | Klingman | 294/86.22 X |

*Primary Examiner*—Johnny D. Cherry

*Attorney, Agent, or Firm*—Burns, Doane, Swecker & Mathis

[57] ABSTRACT

A fishing tool for retrieving broken or lost implements from a drilled hole includes a one-piece body having a bore extending from one end to the other. Oppositely positioned and inwardly directed male keys extend from the inner surface of the bore. The male keys extend along a substantial portion of the length of the bore and engage oppositely positioned portions of a catch slip. The catch slip is slidable along the length of the bore and is guided by the male keys and supported by the inner surface of the bore. The lower end of the body may be provided with a removable guide bushing and a removable guide for retaining the guide bushing in place at the lower end of the body. A front face of the catch slip may be provided with a buttress thread for firmly grasping the implement being retrieved and for permitting the grasped implement to be released while it is still in the hole through rotation of the tool.

34 Claims, 5 Drawing Sheets

98
H
34

44
42
30
50
32
40
46
48
36
38
T

Fig. 15
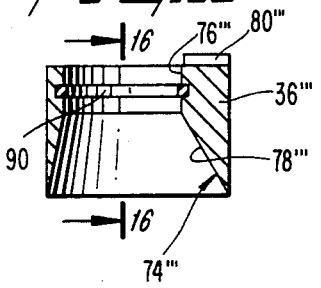
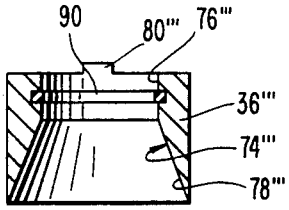
Fig. 16
Fig. 17
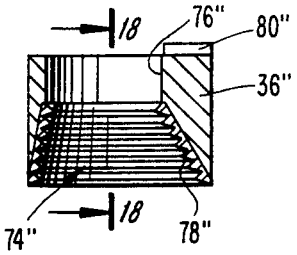
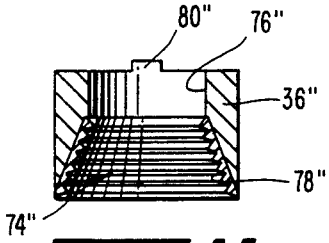
Fig. 18
Fig. 19
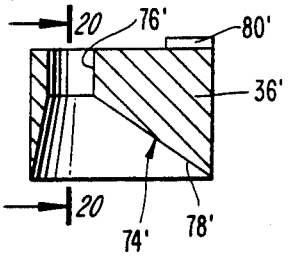
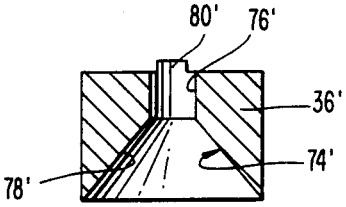
Fig. 20
Fig. 21
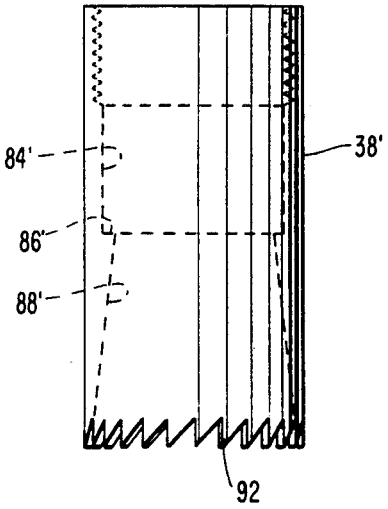
Fig. 22
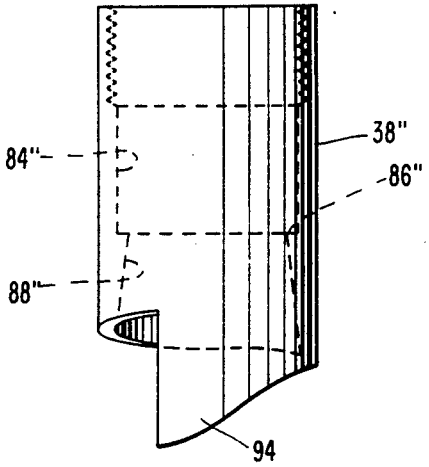

FISHING TOOL FOR RETRIEVING IMPLEMENTS FROM A HOLE

FIELD OF THE INVENTION

The present invention relates to a tool for retrieving implements from a hole. More particularly, the present invention concerns a fishing tool for removing broken or lost tools, implements and the like, otherwise known as fish, from drilled holes.

BACKGROUND AND SUMMARY OF THE INVENTION

During the drilling of oil wells, gas wells and the like, tools, rods and other implements used during the drilling operation may occasionally break or otherwise become lost in the hole. Thus, it becomes necessary to retrieve those lost and broken implements. One type of tool commonly used for that purpose is a fishing tool, as it is commonly referred to in the industry.

Various types of fishing tools have been proposed for retrieving lost and broken implements from drilled holes. For example, U.S. Pat. Nos. 1,491,463 and 1,778,968 disclose fishing tools which include one or more gripping blocks slidably positioned within a bore extending through the tool. The gripping blocks have male keys that fit within slots in the side wall of the bore for supporting the gripping blocks in the bore and for guiding the gripping blocks as they slide along the length of the bore. Unfortunately, the bore in those tools opens through one side of the tool so that the rear surface of the gripping block is not suitably supported by the wall of the bore. When an implement to be retrieved is pinched between the gripping block and the inner wall of the bore, the force that is applied to the gripping block is transferred to the male keys on the gripping blocks. If the force is large enough, the male keys may become damaged. As a result, proper operation of the fishing tool may be adversely affected. It would be desirable, therefore, to develop a fishing tool that is not susceptible to the foregoing drawback.

Other fishing tools such as those disclosed in U.S. Pat. Nos. 1,616,024, 1,732,962, 2,067,009 and 2,201,434 have a main body portion that is fabricated from a plurality of parts. For instance, some of those fishing tools include a separate piece that is secured to the inner surface of the bore for defining an inclined surface upon which the gripping block can be slid. Those fishing tools are fabricated from a plurality of parts which contribute to the complexity and cost of the fishing tool. Further, the multi-part construction requires that those tools be continually checked to ensure that all of the parts are properly positioned relative to one another. Moreover, during use, the connections which secure the various parts of the fishing tool to one another may fail. In view of those disadvantages, it is desirable to design a fishing tool that is simple in construction and reliable during operation.

Some fishing tools, such as the one disclosed in U.S. Pat. No. 2,595,008, are designed in such a manner that it is not possible to interchange the gripping blocks that are used for gripping the implement being retrieved. Consequently, those fishing tools are not well suited for retrieving implements of many different sizes. It can be readily seen, therefore, that it would be advantageous to develop a fishing tool that permits gripping blocks to be readily interchanged for facilitating the retrieval of implements covering a wide range of sizes.

There are specific situations in which it is desirable to provide the bottom portion of the fishing tool with a particular configuration. Similarly, it is desirable in certain instances to provide a smaller or larger opening in the bottom of the fishing tool, depending upon the size of the implement being retrieved and the surrounding conditions. Unfortunately, many of the known fishing tools are not designed to accommodate changes of that sort.

Sometimes, the lost implement is wedged, lodged or otherwise stuck in the hole to such an extent that it may not be possible to pull the lost implement out of the hole once it has been grasped by the fishing tool. Thus, there exists a need for a fishing tool that can readily release an implement while the fishing tool is in the hole.

When an implement has become lost in a hole and needs to be retrieved, it is not always possible to determine with exact precision the size (i.e., diameter or width) of the lost implement. That presents a problem in that typical overshot tools are limited with respect to the size of implements that can be retrieved without changing slips. Thus, if it is found that the fishing tool is not capable of retrieving the implement because the implement is too big, the entire drill string must be removed so that the tool can be outfitted with a different slip. It would be very useful, therefore, to have a fishing tool which possesses the capability of retrieving implements of various sizes without the need for changing the catch slip.

In light of the foregoing drawbacks and disadvantages associated with known fishing tools, it is an object of the present invention to provide a fishing tool that is designed to provide sufficient support for the gripping block, thereby helping to prevent the fishing tool from becoming damaged during use.

It is also an object of the present invention to provide a fishing tool having a body that is fabricated as a single piece, unitary member to reduce the complexity of the structure.

It is another object of the present invention to provide a fishing tool that permits the gripping blocks to be readily interchanged with one another so that the fishing tool can be used to retrieve implements (i.e., fish) covering a wide range of sizes.

It is an additional object of the present invention to provide a fishing tool having readily interchangeable guide bushings and guides so that the configuration of the bottom end of the tool can be varied to suit the particular needs of the operator and the particular conditions of the surrounding environment.

It is another object of the present invention to provide a fishing tool that is capable of easily releasing an implement that has been grasped by the fishing tool while the implement is still in the hole.

A still further object of the present invention is to provide a fishing tool that is able to retrieve lost implements covering a range of sizes without interchanging catch slips.

These and other objects are achieved in accordance with the fishing tool of the present invention which includes an elongated, unitary, one piece body having a bore extending from a bottom end thereof towards an oppositely positioned top end. The bore includes a first bore portion having a longitudinal axis that is substantially parallel to and radially offset with respect to the longitudinal axis of the body and a second bore portion having a longitudinal axis that is transverse to the longitudinal axis of the body. The first and second bore portions are concentric with one another at a point adjacent the bottom end of the body. The body has oppositely positioned male keys extending inwardly from an inner surface of the bore. The male keys extend along a substantial portion of the length of the bore and extend substantially parallel to the second bore portion. A catch slip is slidably positioned within the bore that extends through the body. The catch slip has oppositely positioned slots into which fit one of the male keys for guiding the catch slip as it slides along the length of the bore.

According to further aspects of the present invention, the fishing tool includes a removable guide bushing which is keyed to the bottom end of the body. The guide bushing can be retained in place by a removable guide which is removably secured to the bottom end of the body. The guide bushing and the guide can be configured in various manners to suit the requirements of a particular retrieval operation.

BRIEF DESCRIPTION OF THE DRAWINGS

Preferred embodiments of the present invention will be described in greater detail with reference to the accompanying drawings, wherein like elements bear like reference numerals and wherein:

FIG. 15 is a cross-sectional view of one embodiment of a guide bushing utilized in the fishing tool of the present invention;

FIG. 16 is a cross-sectional view of the guide bushing illustrated in FIG. 15 along the section line 16—16;

FIG. 17 is a cross-sectional view of another embodiment of the guide bushing;

FIG. 18 is a cross-sectional view of the guide bushing illustrated in FIG. 17 along the section line 18—18;

FIG. 19 is a cross-sectional view of another embodiment of the guide bushing;

FIG. 20 is a cross-sectional view of the guide bushing illustrated in FIG. 19 along the section line 20—20;

FIG. 21 is a side view of one embodiment of a guide for use in the fishing tool of the present invention; and FIG. 22 is a side view of another embodiment of the guide.

DETAILED DESCRIPTION OF THE PREFERRED EMBODIMENTS

Figure 1:
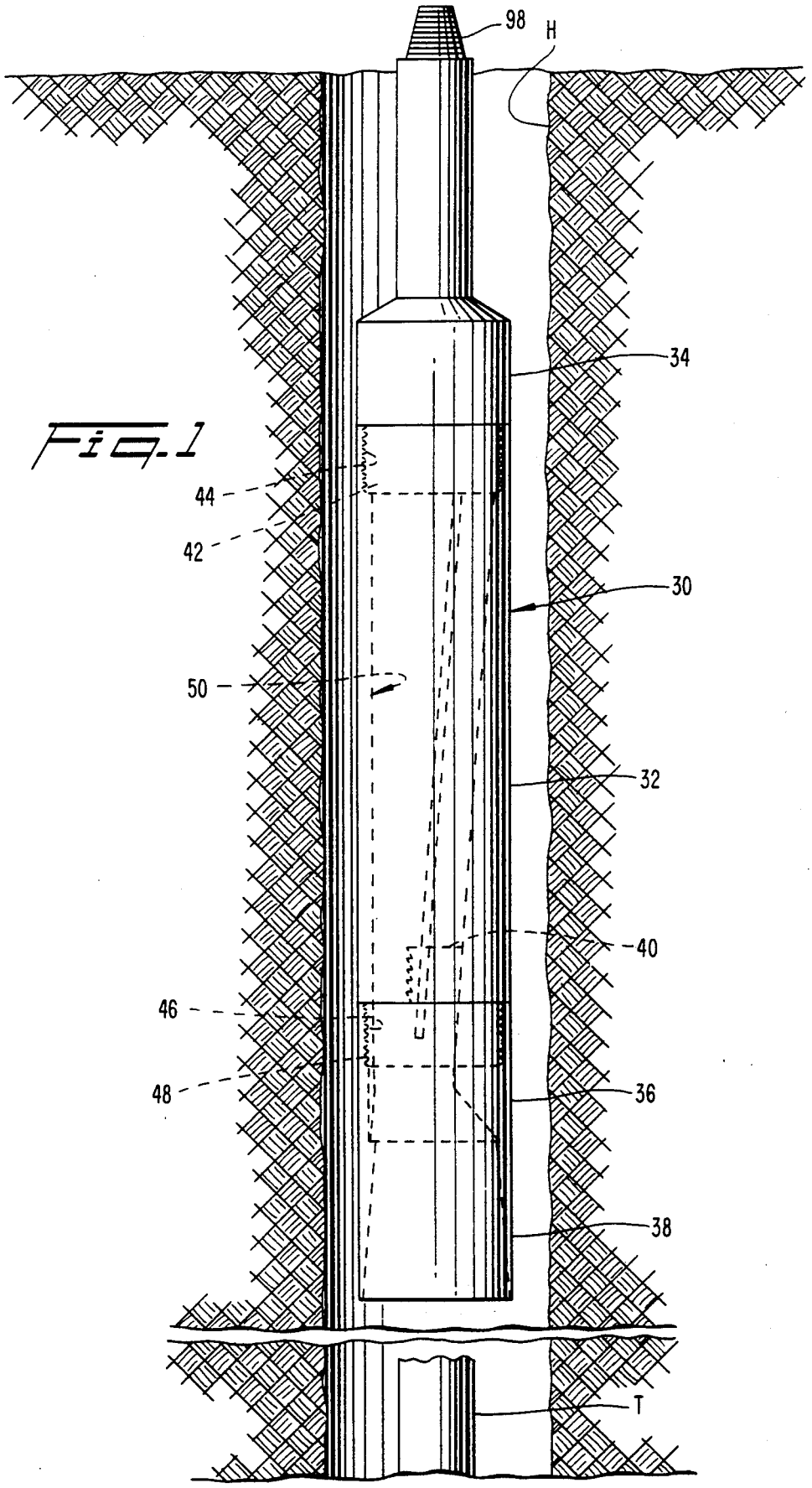
FIG. 1 is a side view of the fishing tool according to the present invention positioned in a hole for retrieving an implement.

The fishing tool 30 according to the present invention includes, as seen in FIG. 1, a middle body section 32 having a top sub section 34 secured thereto. The top sub section 34 can be removably secured to the body 32 by any suitable means such as an externally threaded portion 42 on the lower end of the top sub section 34 and an internally threaded portion 44 on the upper part of the body 32. The fishing tool also includes a guide bushing 36 which is keyed to the lower end of the body 32 by way of a guide projection 80 extending from the guide bushing 36 that engages a complimentary slot 82 formed in the bottom end face of the body 32 (see FIGS. 13 and 14) in a manner that will be described in a little more detail below. An additional feature of the fishing tool is a guide 38 which fits over the guide bushing 36 and retains the guide bushing 36 in place with respect to the lower end of the body 32. The guide 38 can be removably secured to the lower end of the body 32 by any suitable means such as an externally threaded portion 46 on the lower end of the body 32 and an internally threaded portion 48 on the upper end of the guide 38. The fishing tool 30 further includes a catch slip 40 that is slidably positioned within a bore 50 which extends through the body 32. Features relating to the guide bushing 36, the guide 38 and the catch slip 40 will be described in more detail below.

Figure 3:
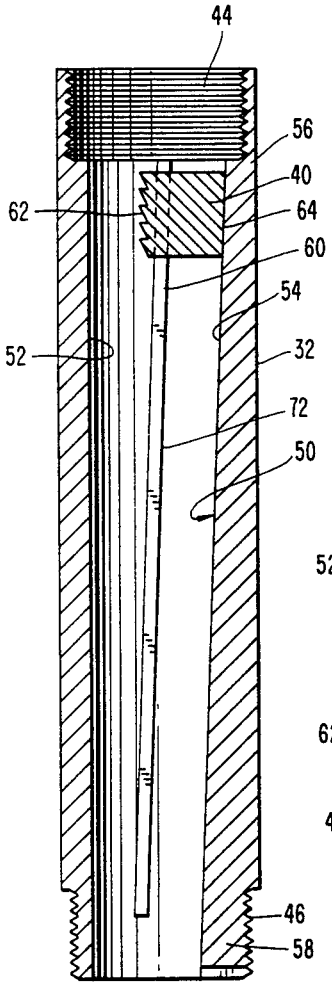
FIG. 3 is a longitudinal cross-sectional view of the fishing tool shown in FIG. 2 along the section line 3—3.

Turning to FIG. 3, the body 32 is fabricated as a one-piece, unitary member that is elongated and generally cylindrical. The bore 50 that extends through the body 32 extends from the bottom end 58 of the body towards the top end 56. Preferably, the bore 50 is open at both ends. It will be noted that the body 32 completely surrounds the bore 50 except at the open ends of the body 32. The bore 50 is actually formed from a combination of two intersecting bore portions; a first bore portion 52 and a second bore portion 54. The first bore portion 52 consists of a cylindrical bore that extends from the top end 56 of the body 32 to the bottom end 58 of the body 32. Preferably, the first bore portion 52 is open at both ends of the body 32. The first bore portion 52 has a longitudinal axis that is substantially parallel to but radially offset with respect to the longitudinal axis of the body 32.

The second bore portion 54 also consists of a substantially cylindrical bore that extends along the length of the body 32 and that preferably opens at the top and bottom ends of the body 32. However, the longitudinal axis of the second bore portion 54 extends at an angle relative to the longitudinal axis of the body 32 as well as the longitudinal axis of the first bore portion 52. The first and second bore portions 52, 54 are arranged with respect to one another such that at or near the bottom end 58 of the body 32, the first and second bore portions 52, 54 are concentric with one another. It is to be understood that the first and second bore portions 52, 54 could be arranged with respect to one another such that they become concentric with one another at some point above the bottom end face of the body 32. Thus, for example, as seen in FIG. 3, the first and second bore portion 52, 54 could become concentric at a point adjacent to where the threads 46 merge into the non-threaded outer surface of the body 32.

The amount of inclination of the second bore portion 54 relative to the first bore portion 52 affects the capabilities of the fishing tool in several respects and thus, in determining the desired inclination of the second bore portion 54, those factors should be taken into consideration. For example, the amount of inclination of the second bore portion 54 will affect the range of implement sizes that can be retrieved with a given catch slip. The greater the angle of inclination of the second bore portion, the greater the range of implement sizes that can be retrieved with a given catch slip. On the other hand, the maximum size of implement that can be retrieved with a given catch slip decreases as the angle of inclination of the second bore portion 54 increases. Thus, it can be seen that the range of implement sizes that can be retrieved with a given catch slip and the maximum size of implement that can be retrieved with a given catch slip are inversely related in that varying the angle of inclination of the second bore portion 54 to increase one causes a decrease in the other.

According to the preferred embodiment, the angle of inclination of the second bore portion 54 is approximately 3°. That angle has been found to provide a reasonable compromise between the maximum size of implement that the fishing tool can retrieve and the range of implement sizes that can be retrieved by the fishing tool with a single catch slip. It is of course to be understood that the angular inclination of the second bore portion 54 can be varied, depending upon whether one is more interested in increasing the range of implement sizes that can be retrieved with the tool or whether one is more concerned with increasing the maximum size of implement that can be retrieved. For instance, the angle of inclination of the second bore portion 54 can be varied between about 1½ and 6°, or greater depending on the function desired.

Figure 2:
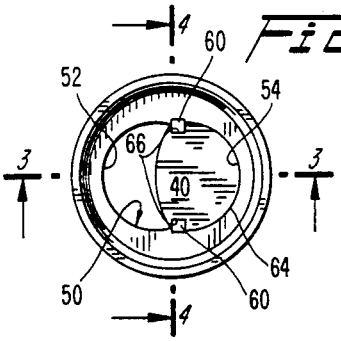
FIG. 2 is a top view of the fishing tool according to the present invention showing the catch slip positioned near the top end of the body.
Figure 6:
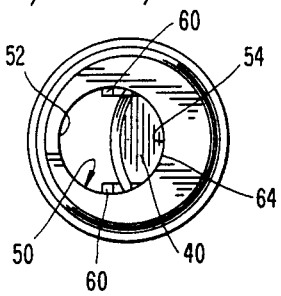
FIG. 6 is a bottom view of the fishing tool according to the present invention showing the catch slip positioned near the top of the body.

As a result of the above-described arrangement of the first and second bore portions 52, 54, the bore 50 extending through the body 32 has a configuration at the upper end 56 of the body 32 as shown in FIG. 2. On the other hand, the bore 50 has a configuration at the bottom end 58 of the body 32 as depicted in FIG. 6. When viewed from the top end 56 of the body 32, the bore 50 is configured as two circles which partially overlap one another. In contrast, when viewed from the bottom end 58 of the body 32, the bore 50 is configured as a single circle. Thus, at the upper end 56 of the body 32, the longitudinal axes of the first and second bore portions 52, 54 are spaced furthest apart from one another. The longitudinal axes of the first and second bore portions 52, 54 converge towards one another until they coincide with one another near the bottom end 58 of the body 32.

Figure 4:
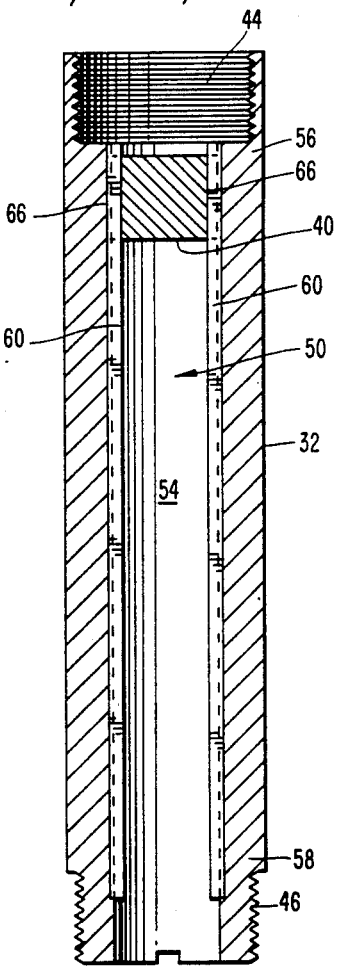
FIG. 4 is a longitudinal cross-sectional view of the fishing tool shown in FIG. 2 along the section line 4—4.

As seen in FIG. 4, two oppositely positioned male keys 60 are integrally formed with and extend inwardly from the inner surface of the bore 50. The male keys 60 extend substantially parallel to the longitudinal axis of the second bore portion 54 and preferably extend along a substantial portion of the length of the bore 50. The male keys 60 serve as a guide for the catch slip 40 which is slidably movable along the length of the bore 50.

Various forms of the catch slip 40 are shown in more detail in FIGS. 7–12. In one embodiment illustrated in FIGS. 7–9, the catch slip 40 has a convex front face 62 and a convex rear face 64. The radius of curvature of the rear surface 64 of the catch slip 40 is substantially equal to the radius of the second bore portion 54 so that the curvature of the rear face 64 of the catch slip 40 matches that of the second bore portion 54.

Oppositely positioned slots 66 are formed in the catch slip 40. The slots 66 are adapted to engage with the male keys 60 which extend inwardly from the bore 50 in the body 32. The interengagement between the male keys 60 and the slots 66 guides the catch slip 40 as it moves along the length of the bore 50. In the preferred embodiment, the slots 66 and the male keys 60 are designed to align and guide the catch slip 40 within the bore 50, and do not provide support for the catch slip 40 as it moves within the bore 50. It is to be understood that the keys could be designed to support the catch slip if desired. However, such a design would be more costly because the keys would have to be made larger in order to support the catch slip and withstand the forces applied thereto.

Figure 8:
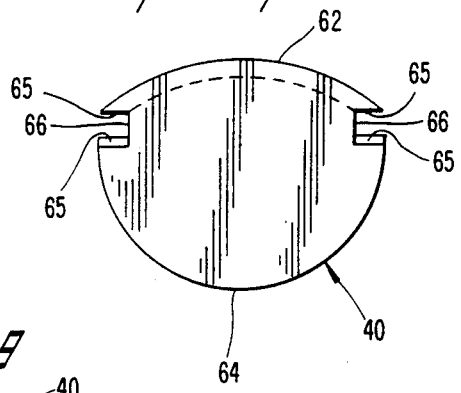
FIG. 8 is a top view of the catch slip illustrated in FIG. 7.
Figure 9:
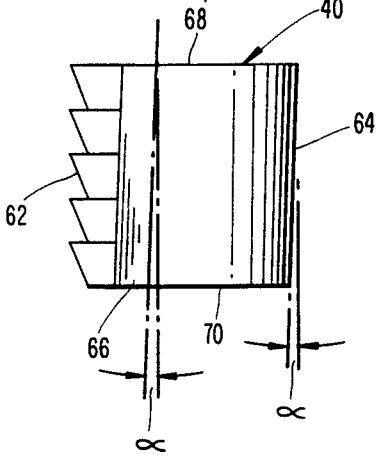
FIG. 9 is a side view of the catch slip illustrated in FIG. 7.

As is most clearly seen from FIG. 9, the rear surface 64 of the catch slip 40 tapers or is angled inwardly from the top end 68 of the catch slip 40 towards the bottom end 70 of the catch slip 40. Also, the facing surfaces 65 (see FIG. 8) that define the slots 66 in the catch slip 40 are similarly angled. The angle $\alpha$ which represents the amount by which the rear face 64 and the facing surfaces 65 defining the slots 66 are angled away from the vertical (i.e., a line perpendicular to the top and bottom ends 68, 70 of the catch slip 40) is substantially equal to the angular inclination of the male keys 60 and the longitudinal axis of the second bore portion 54. Thus, in the preferred embodiment of the fishing tool where the male keys 60 and the longitudinal axis of the second bore portion 54 extend relative to the longitudinal axis of the body 32 at an angle of approximately 3°, the angle $\alpha$ will also be about 3°. It is necessary that the rear surface 64 of the catch slip 40 and the facing surfaces 65 defining the slots 66 be angled to the same extent as the angular inclination of the male keys 60 and the inner surface of the second bore portion 54 to ensure that the catch slip 40 freely slides along the length of the bore 50.

The front face 62 of the catch slip 40 may be formed with a left-hand thread, preferably a left-hand buttress thread. The threaded front face of the catch slip is advantageous in that the implement being retrieved may be lodged or otherwise stuck in the hole to such an extent that after the implement has been pinched between the front face 62 of the catch slip 40 and the facing inner surface of the first bore portion 52, it may be necessary to release the implement while it is still in the hole. The presence of the left-hand threads on the front face of the catch slip will permit the implement to be easily released from the fishing tool by simply rotating the fishing tool to the right. Of course, threads other than buttress threads may be formed on the front face of the catch slip. Similarly, it may be desirable to provide the front face 62 of the catch slip 40 with a right-hand thread, possibly a right-hand buttress thread, in which case the fishing tool can be rotated to the left in order to release the retrieved implement. However, since many of the other threaded connections on the drill string and the tool body include right-hand threads, the use of left-hand threads on the front face of the catch slip is particularly advantageous because the gripped implement can be readily released from the fishing tool without also loosening the other right-hand threaded connections of the drill string and the fishing tool body. Preferably, therefore, the threads on the front face of the catch slip should be threaded in the direction opposite to the direction of the threads on the remainder of the drill string and the fishing tool body.

The threaded front face 62 of the catch slip 40 is also advantageous in that it provides a surface which is able to firmly grip and hold the implement being retrieved.

Figure 10:
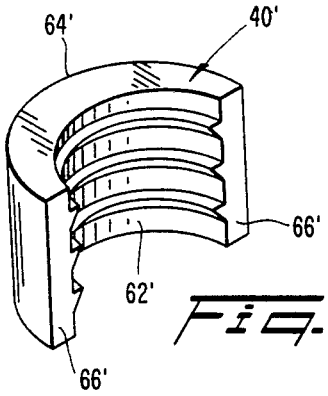
FIG. 10 is a top perspective view of a catch slip according to another embodiment of the present invention.
Figure 11:
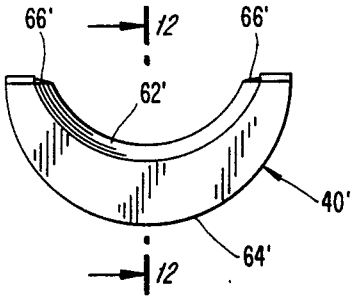
FIG. 11 is a top view of the catch slip illustrated in FIG. 10.
Figure 12:
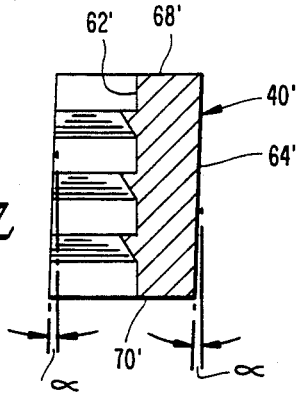
FIG. 12 is a cross-sectional view of the catch slip illustrated in FIG. 11 along the section line 12—12.

An alternative catch slip 40' is illustrated in FIGS. 10–12. According to this alternative embodiment, the catch slip 40' is C-shaped and includes a concave front face 62' and a convex rear face 64'. The radius of curvature of the rear face 64' of the catch slip 40' is substantially equal to the radius of the second bore portion 54. As in the case of the embodiment illustrated in FIGS. 7–9, the front face 62' of the catch slip 40' is provided with left-hand buttress threads for providing the same advantages noted above. As noted above, right-hand buttress threads could be utilized as an alternative. The C-shaped catch slip 40' illustrated in FIGS. 10–12 also includes oppositely positioned end faces 66' which are substantially parallel to one another. The end faces 66' are adapted to be positioned in sliding engagement with the side surfaces 72 (see FIG. 3) of the male keys 60 so that when the catch slip 40' is disposed within the bore 50, the catch slip 40' will be located between the inner surface of the second bore portion 54 and the male keys 60. In that way, the male keys 60 will serve as a guide for guiding the catch slip 40' as it slides along the length of the bore 50.

As most clearly seen in FIG. 12, the rear face 64' of the catch slip 40' tapers or angles inwardly from the top end 68' of the catch slip 40' to the bottom end 70' of the catch slip 40'. The end faces 66' of the catch slip are angled or tapered inwardly in a similar manner. The purpose served by the angled rear face 64' and the angled end faces 66' of the slip catch 40' is the same as that pointed out above with respect to the embodiment of the catch slip illustrated in FIGS. 7–9. The angle $\alpha$ which represents the angular inclination of the rear face 64' and the end faces 66' of the catch slip 40' from the vertical is substantially equal to the angular orientation of the male keys 60 relative to the longitudinal axis of the body 32 as well as the angular orientation of the longitudinal axis of the second bore portion 54 relative to the longitudinal axis of the body 32. Thus, assuming the male keys 60 and the longitudinal axis of the second bore portion 54 are arranged at an angle of approximately 3° with respect to the longitudinal axis of the body 32 as noted above in the preferred embodiment, the angle $\alpha$ will also be about 3°.

Figure 7:
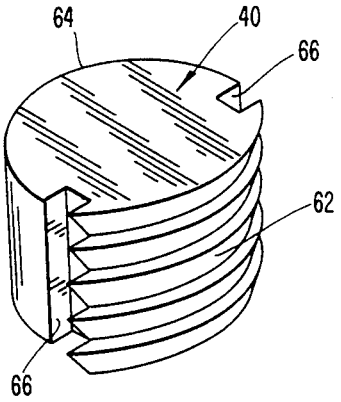
FIG. 7 is a top perspective view of a catch slip according to one embodiment of the present invention.

Preferably, the catch slip 40 illustrated in FIGS. 7–9 and the catch slip 40' illustrated in FIGS. 10–12 are used interchangeably, depending upon the size (i.e. diameter or width) of the implement being retrieved from the drilled hole. If the implement being retrieved has a relatively small diameter or width, it may be more advantageous to use the catch slip 40 illustrated in FIGS. 7–9 because the distance between the front face 62 of the catch slip 40 and the facing inner surface of the first bore portion 52 is better suited for grasping smaller implements. On the other hand, if the implement to be retrieved has a relatively large diameter or width, the catch slip 40' illustrated in FIGS. 10–12 may be more advantageous because the front face 62' of the catch 40' is spaced farther from the facing inner surface of the first bore portion 52 and thus, is able to more readily accommodate and grasp implements of larger size.

It is to be understood that catch slips having sizes different than those illustrated in FIGS. 7–12 could be utilized, depending upon the particular requirements of a given retrieval operation. For example, if an implement to be retrieved has a very small diameter or width, it may be desirable to employ a catch slip similar to that illustrated FIGS. 7–9 which has a front face 62 whose radius of curvature is smaller than that shown in FIGS. 7–9.

A catch slip positioned within the bore 50 can be readily removed and replaced by simply disconnecting the top sub section 34 from the body 32. The catch slip can then be easily slid out of the body 32 and replaced with a more suitable catch slip.

Referring to FIG. 4, the catch slip 40 is shown mounted within the bore 50 in the body 32 with one of the oppositely positioned male keys 60 positioned in each of the slots 66 of the catch slip 40. When the catch slip 40 is positioned in its uppermost position within the bore 50 as seen in FIG. 3, the threaded front face 62 of the catch slip 40 is positioned farthest from the facing inner surface of the first bore portion 52. Also, the catch slip 40 is configured and dimensioned to ensure that when the catch slip 40 is mounted within the bore 50, the rear face 64 of the catch slip 40 contacts and is supported by the inner surface of the second bore portion 54 as best illustrated in FIGS. 2 and 6. Thus, the catch slip is supported within the bore 50 by the inner surface of the second bore portion 54 and not by the keys 60 or the slots 66.

Figure 5:
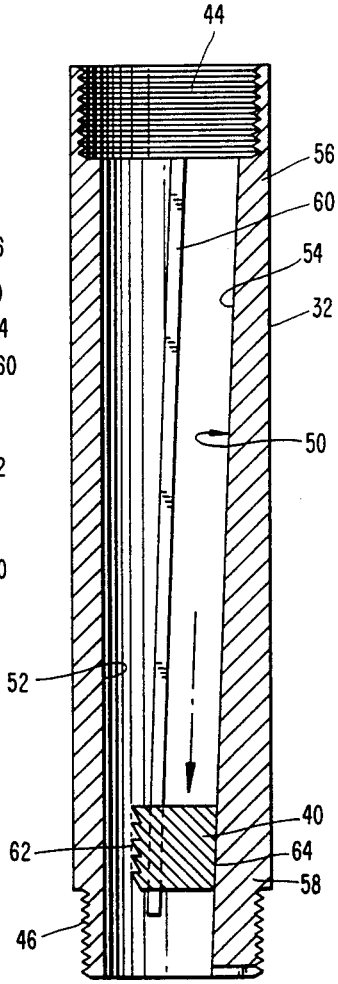
FIG. 5 is a longitudinal cross-sectional view of the fishing tool according to the present invention showing the catch slip positioned near the bottom end of the body.

As the catch slip 40 moves downwardly within the bore 50, the threaded front face 62 of the catch slip 40 moves closer to the facing inner surface of the first bore portion 52. Moreover, since the male keys 60 which guide the catch slip 40 extend substantially parallel to the longitudinal axis of the second bore portion 54, the rear face 64 of the catch slip 40 remains in contact with and is continuously supported by the inner surface of the second bore portion 54. As seen in FIG. 5, when the catch slip 40 approaches its lowermost position within the bore 50, the threaded front face 62 of the catch slip 40 is positioned closest to the facing inner surface of the first bore portion 52.

While FIGS. 3–5 illustrate the sliding movement of the catch slip 40 within the bore 50, it is to be understood that the other embodiment of the catch slip 40' as well as any other variations of the catch slip move within the bore 50 in a similar manner. In the case of the catch slip illustrated in FIGS. 10–12, the oppositely positioned end faces 66' of the C-shaped catch slip 40' are positioned in contact with the side surfaces 72 of the male keys 60 and the rear surface 64' of the catch slip 40' is positioned in contact with and is supported by the inner surface of the second bore portion 54. That position of the catch slip 40' relative to the male keys 60 and the inner surface of the second bore portion 54 is maintained as the catch slip 40' moves along the length of the bore 50. As the catch slip 40' slides downwardly along the length of the bore 50, the thread on the front face 62' of the catch slip 40' moves closer and closer to the facing inner surface of the first bore portion 52 until the catch slip 40′ reaches its lowermost position within the bore 50, at which time the threaded front face is located closest to the facing inner surface of the first bore portion 52.

Figure 13:
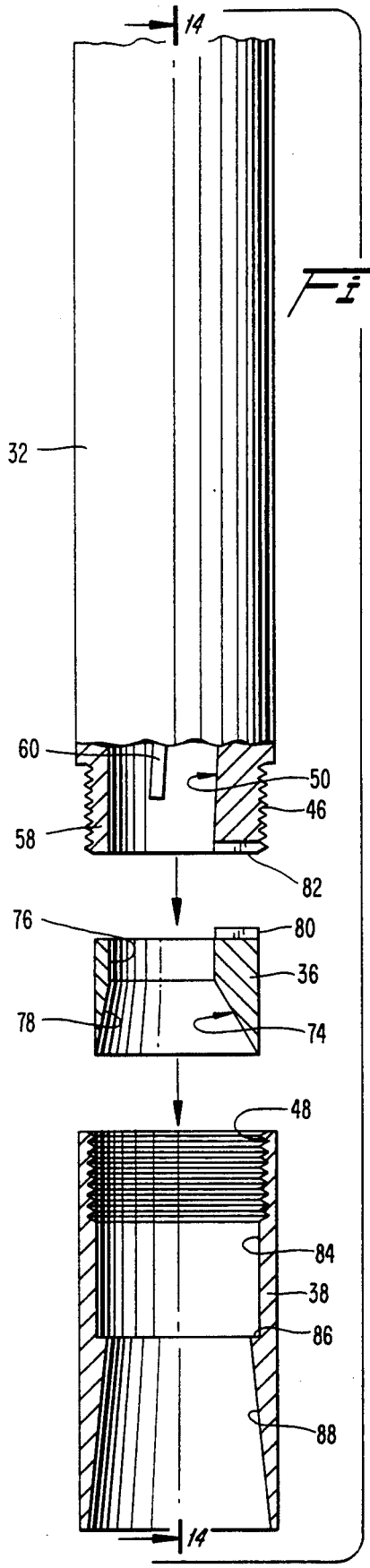
FIG. 13 is a partial longitudinal cross-sectional view of the fishing tool of the present invention illustrating the manner in which the guide bushing and the guide are mounted on the bottom end of the body.
Figure 14:
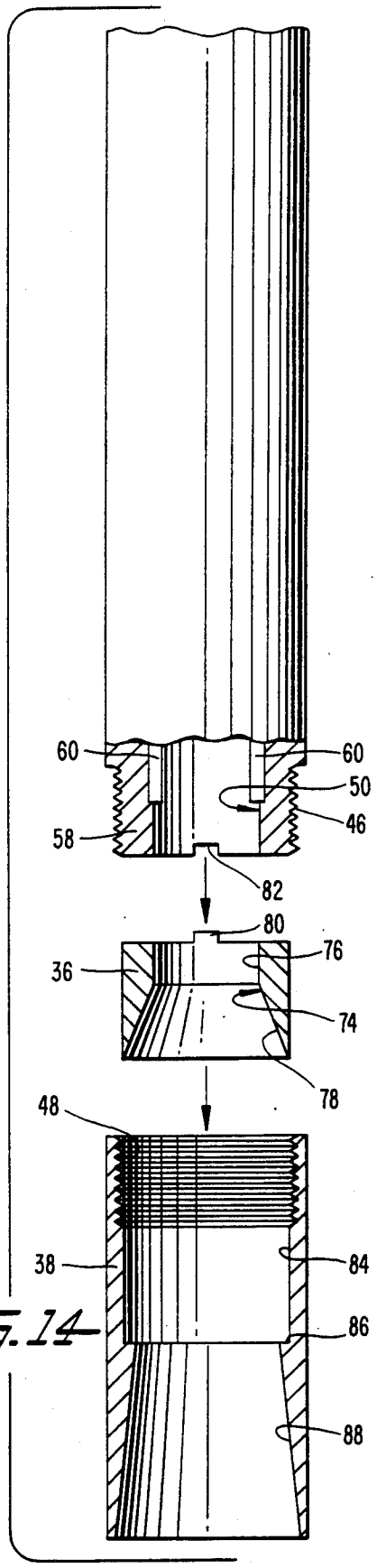
FIG. 14 is a partial longitudinal cross-sectional view of the fishing tool illustrated in FIG. 13 along the section line 14—14.

Turning to FIGS. 13 and 14, another advantageous feature of the fishing tool according to the present invention resides in the removable guide bushing 36 and the removable guide 38 that are located at the bottom and of the body 32. With reference first to FIG. 13, a bore 74 extends through the guide bushing 36. The bore 74 includes an upper cylindrical portion 76 and a lower outwardly tapering portion 78. An alignment projection 80 extends upwardly from the upper surface of the guide bushing 36 and fits into a recess 82 located in the lower end surface of the body 32. The outer diameter of the guide bushing 36 corresponds substantially to the root diameter of the threaded portion 46 located at the bottom end 58 of the body 32. In that way, the guide 38 can fit over the guide bushing 36 in order to retain the guide bushing 36 in place.

The cylindrical part 76 of the bore 74 extending through the guide bushing 36 should preferably be aligned with the bore 50 which extends through the body 32. Since the bore 50 at the lower end of the body 32 is radially offset with respect to the longitudinal axis of the body 32, the alignment projection 80 and the corresponding recess 82 are provided for ensuring alignment of the cylindrical portion 76 of the bore 74 in the guide bushing 36 with the bore 50 in the body 32. Also, the interengagement of the alignment projection 80 and the recess 82 helps ensure that rotation of the body 32 results in rotation of the guide bushing 36 which, as will become apparent from the description below, may be desirable in certain circumstances.

As further seen in FIGS. 13 and 14, the guide 38 is substantially cylindrical. The upper portion of the guide 38 includes a cylindrical recess 84 which receives the guide bushing 36 when the guide 38 is positioned over the guide bushing 36 and secured to the lower end of the body 32. An inwardly directed shoulder 86 is formed at the bottom of the cylindrical recess 84 for seating the guide bushing 36 in order to retain the guide bushing 36 in place with respect to the lower end of the body 32. The cylindrical recess 84 communicates with an outwardly tapering bore 88. The outwardly tapering configuration of the bore 88 helps guide the implement to be retrieved into the guide bushing 36.

The guide bushing 36 illustrated in FIGS. 13 and 14 is well suited for guiding implements of relatively large diameter or width into the body 32 as a result of the relatively large diameter of the bore 74 extending through the guide bushing 36. In view of the removable nature of the guide bushing 36 and the guide 38, other types of guide bushings can be employed as an alternative to the guide bushing 36 shown in FIGS. 13 and 14 depending upon the requirements of a given situation. For example, as illustrated in FIGS. 19 and 20, the guide bushing 36′ can include a bore 74′ having a smaller upper cylindrical portion 76′. The guide bushing 36 illustrated in FIGS. 13 and 14 may be better suited for retrieving implements having a relatively large diameter or width whereas if the implement being retrieved possesses a relatively small diameter or width, the guide bushing 36′ illustrated in FIGS. 19 and 20 may be more suitable.

Alternatively, as seen in FIGS. 17 and 18, the inner surface of the outwardly flared portion 78″ of the bore 74″ extending through the guide bushing 36″ can be threaded or otherwise provided with an abrasive surface for milling and cutting. The interengagement between the alignment projection 80″ on the guide bushing 36″ and the recess 82 in the bottom of the body 32 ensures that the guide bushing 36″ will rotate in conjunction with rotation of the body 32, thereby allowing the aforementioned milling and cutting operation to be effectively carried out.

In a further alternative embodiment which is illustrated in FIGS. 15 and 16, the guide bushing 36‴ can be provided with a rubber pack-off ring 90 positioned in the upper cylindrical portion 76‴ of the guide bushing 36‴.

It is to be understood that, where appropriate, the above-described features relating to the guide bushing can be used in conjunction with one another. For example, the pack-off ring 90 illustrated in FIGS. 15 and 16 could be used in conjunction with the guide bushing 36 shown in FIGS. 13 and 14 as well as with the guide bushing 36′ illustrated in FIGS. 19 and 20. Similarly, the abrasive surface provided on the outwardly flared portion of the bore 78″ extending through the guide bushing 36″ as illustrated in FIGS. 17 and 18 could be used in conjunction with any of the illustrated guide bushings.

Preferably, the size of the opening in the cylindrical part 76, 76′, 76″, 76‴ of the guide bushing and the positioning of the cylindrical part with respect to the bore 50 is such that when an implement is guided into the body 32, the implement is prevented from contacting and damaging the male keys 60. Thus, the size (i.e., diameter) of the cylindrical portion 76, 76′, 76″, 76‴ in the guide bushing should preferably be equal to or less than the distance between the two male keys 60.

The male keys 60 and the guide bushing are preferably designed such that the guide bushing serves as a stop for the catch slip. When the guide bushing is keyed to the bottom end of the body 32 and retained in place by the guide, the top surface of the guide bushing is positioned such that it limits downward movement of the catch slip. Moreover, the male keys 60 extend downwardly far enough to ensure that when the catch slip contacts the guide bushing, the male keys 60 still engage the slots or the and faces of the catch slip. Thus, as the catch slip moves downwardly within the bore 50, its lower surface will eventually come into contact with the upper surface of the guide bushing, thereby serving as a stop for preventing further movement of the catch slip.

As an alternative, a suitable stop can be provided either at the lower ends of the male keys 60 or extending inwardly from the inner surface of the bore 50 for limiting the downward movement of the catch slip within the bore. Also, the lower end of the top sub section 34 serves as a stop for limiting the amount of upward movement of the catch slip 40.

FIGS. 21 and 22 depict different types of guides that could be used as an alternative to the guide 38 shown in FIGS. 13 and 14. As illustrated in FIG. 21, the guide 38′ can be provided with a serrated bottom face 92. Alternatively, as illustrated in FIG. 22, the bottom surface of the guide 38″ can be provided with a pointed and sharply angled generally triangular extension or cut-lip 94.

Referring back to FIG. 1, the top sub section 34 of the fishing tool 30 may be provided with an externally threaded portion 98 for attachment in the usual way to a string of pipe so that the fishing tool can be lowered into a hole or well H for retrieving a broken or lost implement T. During use, as the fishing tool 30 is lowered into the hole or well H, the implement T to be retrieved, commonly referred to as a fish, will be guided upwardly into the body 32 as a result of the flared lower portion 88 of the guide 38 as well as the flared lower bore portion 78 of the guide bushing 36. Eventually, as the fishing tool 30 is lowered further, the fish T will contact the catch slip 40 which is located in its lowermost position (i.e., a position close to that illustrated in FIG. 5) as a result of gravity. The fish T will cause the catch slip 40 to move upwardly until the catch slip 40 has moved away from the facing inner surface of the first bore portion 52 a sufficient distance to permit the fish T to be positioned between the threaded front face 62 of the catch slip 40 and the facing inner surface of the first bore portion 52. When the fishing tool 30 is pulled upwardly, the fish T will be pinched and firmly gripped between the threaded front face 62 of the catch slip 40 and the facing inner surface of the first bore section 52. Thereafter, the fish T can be withdrawn from the hole H.

If it is necessary to release the fish for any reason while the fish is still in the hole, the fishing tool can be simply rotated to the right, assuming that the front face of the catch slip is provided with left-hand threads.

As a result of the above-described construction of the fishing tool 30 according to the present invention, several advantages can be realized. For example, the one piece, unitary construction of the body allows the fishing tool to be easily and readily manufactured without the need for assembling a plurality of parts. Further, that feature combined with the manner in which the catch slip is mounted within the bore and supported by the inner surface of the bore results in a fishing tool which possesses great structural integrity. That feature is particularly desirable because sometimes, the implement being retrieved is lodged or otherwise stuck in the hole, thus requiring a large tension force to pull the implement out of the hole. Since the catch slip is supported against the inner surface of the second bore portion, the force that is applied to the catch slip as the implement is pulled out of the hole is transferred to the body. As a result, the force applied to the catch slip is distributed over the body and is not supported solely by the catch slip and the keys.

The angular inclination of the second bore portion 54 and the male keys 60 produces a fishing tool that is able to retrieve implements of various sizes without the need for changing the catch slip. Typically, a fishing tool of conventional length provided with a given catch slip and having a second bore portion that is inclined at an angle of about 3° will be able to retrieve implements which differ in size by about one-half of an inch.

The ability of the fishing tool to be outfitted with catch slips of different configurations permits the fishing tool to be better adapted to retrieve implements of varying size, thereby making the fishing tool more versatile. Similar advantages also arise from the ability of the fishing tool to be outfitted with a guide having different size bores. Further, since the fishing tool can be outfitted with guide bushings and guides having various configurations for permitting, for example, milling and cutting as well as pack-off on the fish, the fishing tool can be easily adapted for various needs and environments.

The principles, preferred embodiments and modes of operation of the present invention have been described in the foregoing specification. However, the invention which is intended to be produced is not to be construed as limited to the particular embodiments disclosed. The embodiments are to be regarded as illustrative rather than restrictive. Variations and changes may be made by others without departing from the spirit of the present invention. Accordingly, it is expressly intended that all such variations, changes and equivalents which fall within the spirit and scope of the present invention as defined in the claims be embraced thereby.

What is claimed is:

1. A fishing tool for retrieving implements from a drilled hole, comprising:

an elongated single piece body having a centrally located longitudinal axis, said body having a bore extending from a bottom end of the body towards an oppositely positioned top end of the body, said bore being entirely surrounded by the body along substantially its entire length and said body including first and second generally cylindrical bore portions, said first bore portion extending substantially parallel to and being radially offset with respect to the longitudinal axis of the body, said second bore portion extending at an angle relative to the longitudinal axis of the body and the longitudinal axis of the first bore portion, said second bore portion being concentric with the first bore portion at a point adjacent the bottom end of the body, said body having oppositely positioned male keys integrally formed with and extending away from an inner surface of the bore, said male keys extending along a substantial portion of the length of the bore and extending substantially parallel to the longitudinal axis of the second bore portion;

a catch slip slidably positioned in the bore, said catch slip having means positioned on opposite sides thereof for interacting with the male keys to guide the catch slip within the bore in a direction substantially parallel to the longitudinal axis of the second bore portion, said catch slip being able to retrieve implements of various sizes and said catch slip having a front face and an oppositely positioned rear face, the front face of the catch slip having a thread formed thereon which faces an inner surface of the first bore portion so that an implement being retrieved can be gripped between the thread and the facing inner surface of the first bore portion and so that a gripped implement can be readily released by rotating the tool, the rear surface of the catch slip having a radius of curvature that is substantially the same as the radius of the second bore portion so that said rear surface is in contact with and supported by an inner surface of the one-piece body from one male key to the other male key along the second bore portion, structural support for the catch slip during retrieval operations being provided by the single piece body while the male keys serve to guide the catch slip as it moves along the bore in the body;

a removal guide bushing disposed at the bottom end of the body, said guide bushing having a bore extending therethrough that is aligned with the bore extending through the body; and a guide positioned over the guide bushing to retain the guide bushing in place with respect to the body, an upper end of the guide and the bottom end of said body including means for removably attaching the guide to the body.

2. The fishing tool according to claim 1, wherein the threaded front face of the catch slip is a left-hand buttress thread.

3. The fishing tool according to claim 1, wherein the front face of the catch slip is convex and the rear face of the catch slip is convex, said means formed on opposite sides of the catch slip for interacting with the male keys including oppositely positioned slots formed in the catch slip which individually receive one of the male keys.

4. The fishing tool according to claim 1, wherein the catch slip is generally C-shaped with a concave front face and a convex rear face, said means formed on opposite sides of the catch slip for interacting with the male keys being defined by end faces of the C-shaped catch slip which contact side surfaces of the male keys.

5. The fishing tool according to claim 1, wherein said second bore portion extends at an angle of between about $1\frac{1}{2}°$ and 6° relative to the longitudinal axes of the body and the first bore portion.

6. The fishing tool according to claim 5, wherein said second bore portion extends at an angle of about 3° relative to the longitudinal axes of the body and the first bore portion.

7. The fishing tool according to claim 1, wherein said second bore portion extends at an angle of at least $1\frac{1}{2}°$ relative to the longitudinal axes of the body and the first bore portion.

8. The fishing tool according to claim 1, wherein there is no more than one catch slip slidably positioned within the bore of the body, said catch slip being a one-piece catch slip.

9. The fishing tool according to claim 8, wherein the top end of the body is removably connected to a top sub section to permit access to the bore when the top sub section is removed from the body.

10. The fishing tool according to claim 9, wherein said means for removably attaching the guide to the body includes a threaded connection, the thread on the front face of the catch slip and the threaded connection between the guide and the body being oppositely threaded so as to permit a retrieved implement to be released from the grasp of the tool when the tool is in a hole while also preventing the threaded connection from being loosened.

11. A tool for retrieving implements from a hole, comprising:

an elongated one-piece body having a bore extending from a bottom end of the body towards an oppositely positioned top end of the body, said bore having an inner surface which includes a first portion and an oppositely positioned second portion which both extend along the length of the bore, said first portion of the inner bore surface extending substantially parallel to the longitudinal axis of the body and said second portion of the inner bore surface extending at an angle to the longitudinal axis of the body, said first and second portions of the inner bore surface being defined about respective longitudinal axes, the longitudinal axis of the first portion of the inner bore surface being radially offset with respect to the longitudinal axis of the body, said bore having oppositely positioned male keys formed integrally with and extending inwardly from the inner surface of the bore, said male keys extending substantially parallel to the second portion of the inner bore surface; and a catch slip slidably positioned within the bore, said catch slip having means for interacting with the male keys to guide the catch slip in a direction substantially parallel to the second portion of the inner surface as the catch slip slides along the length of the bore in the body, said catch slip having a rear surface that is in contact with and supported by the second portion of the inner bore surface from one male key to the other male key, structural support for the catch slip during retrieval operations being provided by the one-piece body while the male keys serve to guide the catch slip as it moves along the bore in the body.

12. The tool according to claim 11, wherein said bore is other than circular at a point adjacent the top end of the body and is substantially circular at a point adjacent the bottom end of the body, the bore having a center that is radially offset from the longitudinal axis of the body at the point where the bore is circular.

13. The tool according to claim 11, including a removable guide bushing disposed at the bottom end of the body, said guide bushing having a bore extending therethrough that communicates with the bore in the body.

14. The tool according to claim 13, including alignment means for aligning the guide bushing with respect to the body such that the bore in the body is aligned with the bore in the guide bushing.

15. The tool according to claim 13, wherein the bore in the guide bushing includes a cylindrical upper portion which is aligned with the bore in the body and an outwardly flared lower portion for directing the implement to be retrieved into the cylindrical upper portion.

16. The tool according to claim 15, wherein the distance between the male keys is at least equal to the distance across the cylindrical upper portion.

17. The tool according to claim 15, wherein the cylindrical upper portion of the bore in the guide bushing includes a rubber pack-off ring.

18. The tool according to claim 15, wherein the outwardly flared lower portion of the bore in the guide bushing includes an abrasive inner surface for milling and cutting.

19. The tool according to claim 13, including a removable guide which fits over the guide bushing and retains the guide bushing in place relative to the body, and means for removably connecting the guide to the bottom end of the body.

20. The tool according to claim 19, wherein the guide has a bottom end surface that is serrated.

21. The tool according to claim 19, including a sharp, generally triangular projection extending from a bottom end surface of the guide.

22. The tool according to claim 13, including means for permitting a gripped implement to be released from the grasp of the tool while the gripped implement is in a hole.

23. The tool according to claim 22, wherein said guide bushing includes threads formed at an upper end thereof that engage threads formed on the lower end of the body, said means for permitting a gripped implement to be released from the grasp of the tool while the gripped implement is in a hole including threads formed on a front face of the catch slip, said threads formed on the front face of the catch slip being threaded opposite to the threads located on the lower end of the body and the threads located at the upper end of the guide bushing.

24. The tool according to claim 11, wherein said catch slip has a rear face and an oppositely positioned front face that faces the first portion of the inner bore surface, the rear face of the catch slip being convex and the radius of curvature of the second portion of the inner bore surface being substantially equal to the radius of curvature of the rear face of the catch slip, the rear face of the catch slip contacting and being supported substantially entirely by the second portion of the inner bore surface.

25. The tool according to claim 24, wherein the front face of the catch slip is convex and includes a left-hand thread for gripping the implement to be retrieved and for permitting the implement to be easily released from the tool while the implement is in the hole through rotation of the tool.

26. The tool according to claim 25, wherein said means for interacting with the male keys includes oppositely positioned slots formed in the catch slip which receive one of said male keys.

27. The tool according to claim 24, wherein said catch slip is generally C-shaped and includes a concave front face which has a left-hand thread formed thereon for gripping the implement to be retrieved and for permitting the gripped implement to be released when the implement is in the hole by rotating the tool.

28. The tool according to claim 27, wherein said means for interacting with the male keys includes oppositely positioned end faces of the C-shaped catch slip which contact side surfaces of the male keys for guiding the catch slip during sliding movement within the bore.

29. The tool according to claim 11, wherein said second portion of the inner bore surface extends at an angle of between about $1\frac{1}{2}$ and 6° relative to the longitudinal axis of the body.

30. The tool according to claim 29, wherein said second portion of the inner bore surface extends at an angle of about 3° relative to the longitudinal axis of the body.

31. The tool according to claim 11, wherein said second portion of the inner bore surface extends at an angle of at least $1\frac{1}{2}$ relative to the longitudinal axis of the body.

32. The fishing tool according to claim 11, wherein there is no more than one catch slip slidably positioned within the bore of the body, said catch slip being a one-piece catch slip.

33. The fishing tool according to claim 32, wherein the top end of the body is removably connected to a top sub section to permit access to the bore when the top sub section is removed from the body.

34. The fishing tool according to claim 33, including a removable guide bushing disposed at the bottom end of the body, said guide bushing having a bore extending therethrough that communicates with the bore in the body, and a removable guide that fits over the guide bushing and retains the guide bushing in place relative to the body, said guide being removably connected to the bottom of the body by way of a threaded connection, said catch slip having a front face that is threaded to facilitate grasping of an implement being retrieved, the threaded connection between the body and the guide being threaded opposite to the thread on the front face of the catch slip to permit a retrieved implement to be released from the grasp of the tool when the tool is in a hole while also preventing the threaded connection from being loosened.

* * * * *